US006527235B1

(12) United States Patent
Cotterill

(10) Patent No.: US 6,527,235 B1
(45) Date of Patent: Mar. 4, 2003

(54) DESK ACCESSORY SUPPORT

(75) Inventor: Michael J. Cotterill, Canyonleigh (AU)

(73) Assignee: Michael John Cotterill (AU)

( * ) Notice: Subject to any disclaimer, the term of this patent is extended or adjusted under 35 U.S.C. 154(b) by 0 days.

(21) Appl. No.: 09/485,554

(22) PCT Filed: Aug. 12, 1998

(86) PCT No.: PCT/AU98/00636

§ 371 (c)(1),
(2), (4) Date: May 15, 2000

(87) PCT Pub. No.: WO99/08566

PCT Pub. Date: Feb. 25, 1999

(30) Foreign Application Priority Data

| | | |
|---|---|---|
| Aug. 15, 1997 | (AU) | PO 8627 |
| Aug. 18, 1997 | (AU) | PO 8632 |
| Dec. 15, 1997 | (AU) | PO 0949 |
| Aug. 12, 1998 | (AU) | PO 8525 |

(51) Int. Cl.[7] ..... B43L 15/00

(52) U.S. Cl. ..... 248/118.3; 248/118; 248/118.1; 248/118.5; 248/917; 248/918; 108/97; 108/96

(58) Field of Search ..... 248/118.3, 118, 248/118.1, 281.11, 231.81, 918, 118.5, 205.1, 917, 919, 920; 108/97, 96, 65

(56) References Cited

U.S. PATENT DOCUMENTS

| | | | | |
|---|---|---|---|---|
| 2,914,191 A | * | 11/1959 | Bowden et al. | 211/153 |
| 3,741,131 A | * | 6/1973 | Leadbetter | 108/97 |
| 3,989,213 A | * | 11/1976 | Allen | 248/214 |
| 4,901,969 A | | 2/1990 | Yaeger | 248/455 |
| 5,046,880 A | | 9/1991 | Steinhilber | |
| 5,302,015 A | | 4/1994 | Du Vall | |
| 5,317,977 A | * | 6/1994 | Omessi | 108/97 |
| 5,320,313 A | * | 6/1994 | Crowe | 248/231.6 |
| 5,351,897 A | | 10/1994 | Martin | |
| 5,661,605 A | * | 8/1997 | Conway | 361/680 |
| 5,735,222 A | * | 4/1998 | Webb | 108/144 |
| 5,836,562 A | * | 11/1998 | Danzyger et al. | 248/295.11 |
| 5,848,773 A | * | 12/1998 | Bourassa | 248/298.1 |
| 5,876,002 A | * | 3/1999 | White et al. | 248/118 |
| 6,079,680 A | * | 6/2000 | Kochanski et al. | 248/231.81 |
| 6,116,557 A | * | 9/2000 | Choy et al. | 248/286.1 |

FOREIGN PATENT DOCUMENTS

| | | | |
|---|---|---|---|
| DE | 38 40 893 A1 | 6/1990 | A47B/17/03 |
| DE | 43 36 141 A1 | 4/1995 | |
| EP | 0 642 752 A1 | 3/1995 | |
| EP | 0 775 456 A2 | 5/1997 | |

* cited by examiner

*Primary Examiner*—Kimberly Wood
(74) *Attorney, Agent, or Firm*—Fenwick & West LLP

(57) ABSTRACT

A desk accessory support for use with a desktop has an upper surface, a lower surface and an edge extending between the upper and lower surfaces. The support includes a first abutment for abutting the upper surface, and a second abutment for abutting the lower surface. A connecting structure is configured for connecting the first and second abutments to each other. The first and second abutments and the connecting structure define a substantially U-shaped recess for receiving the edge of the desktop.

12 Claims, 16 Drawing Sheets

DESK ACCESSORY SUPPORT

TECHNICAL FIELD

The present invention relates to means for supporting a keyboard, a VDU monitor or the like in relation to a desk having an upper surface and an opposed lower surface.

The invention has been developed primarily for use with an office desk or work station and will be described hereinafter with reference to that application. However, it will be appreciated that the invention is not limited to that particular field of use and is also applicable to other work surfaces, storage surfaces or the like.

BACKGROUND ART

Hitherto, the inclusion of a keyboard platform on an office desk has necessitated specific mechanical alterations of that desk (for example a cut out section) to accommodate the linkage mechanism joining the platform to the desk. This is particularly so for linkage mechanisms which allow height adjustment of the keyboard platform. Because of the many configurations and variations required to meet the specific demands of the office and consumer markets it is difficult for manufacturers to conveniently and cost effectively produce the desks and associated keyboard supporting platforms.

The keyboard to be placed on the keyboard platform is generally associated with a computer having a screen which is located on the desk surface. However, the narrow width of most modern desks makes it increasingly difficult, even with the use of known keyboard platforms, to maintain a distance between the screen and the eyes of the operator using a keyboard which meets the internationally recognised optimum of 550 mm. Moreover, once an optimum is achieved, further height or angular adjustment of the screen is generally impracticable, whether it be to share screen information or for operator convenience of comfort. Attempts to provide adjustable monitor supports also suffer from the disadvantage of requiring desk surface modifications. To avoid this it has been proposed to employ a monitor platform attached to the desk via an arm extending from a screw clamp. Such arrangements are often insecure because of the weight of the monitor. Screw clamps cannot be placed at the front edge of the desk because their bulk interferes with the attachment and/or use of a keyboard and renders the desk surface unusable. Attachment of screw clamps at the desk rear or desk side edges tends to damage the desk and to interfere with placement of desks against a wall or screen (if clamped at the rear) or side-by-side (if clamped at the side). In general, monitor supports tend to occupy an excessive desk area or interfere with desk space.

It is an object of the present invention, at least in the preferred embodiment, to overcome or substantially ameliorate one or more of the disadvantages of the prior art.

DISCLOSURE OF THE INVENTION

According to one aspect of the invention there is provided a desk accessory support adapted to co-operate with a desktop having an upper surface and a lower surface, the support including:

a first abutment means adapted to abut the upper surface;

a second abutment means adapted to abut the lower surface;

a connection means for coupling the first and second abutment means whereby in use, the connection means is disposed adjacent to an edge of the desktop and the first and second abutment means co-operatively grip the desktop; and at least one accessory bearing means coupled to the first or second abutment means.

Preferably the first abutment means includes a substantially upper planar surface, and the connection means includes a planar portion extending between the first and second abutment means, where in use, the connection means is disposed to abut a non linear edge of the desktop at two locations, and at least a portion of the first abutment means spans the region defined by the connection means and the portion of the non linear edge of the desktop in between the two locations.

Preferably the first and second abutment means include substantially parallel upper and lower planar fins respectively, which in use extend away from the edge of the desktop and along at least a portion of the respective upper and lower surface.

Alternatively the first abutment means includes a substantially planar upper fin and the second abutment means includes a bent planar lower fin having a first portion adjacent the connection means and extending away from both the connection means and the upper fin, and a second portion disposed at a direction towards the upper fin and extending away from the connection means and the first portion, where in use the two abutment means extend away from the edge of the desktop and along at least a portion of the respective upper and lower surface.

Preferably the grip is a resilient clamping grip and the first and second abutment means are resiliently biased into abutment with the upper and lower surface of the desk.

Alternatively the grip is an engaging grip.

Preferably the first and second abutment means are substantially rectangular.

Preferably the first and second abutment means are plates.

Optionally the first and second abutment means are releasably connected together, and/or are adjustably spaced apart at a predetermined distance. Alternatively the first and second abutment means are integrally formed plates.

Preferably the at least one accessory bearing means is coupled to the first or second abutment means at a distance away from the desk edge.

In a preferred embodiment, an accessory bearing means is coupled to the second abutment means by a cantilevered coupling extending from the second abutment means and in use in a direction towards the desk edge.

Preferably the cantilevered coupling includes a linkage assembly extending from a bracket assembly mounted to the second abutment means.

Preferably the cantilevered coupling allows adjustment of one of the position or orientation of the accessory bearing means.

Preferably the linkage assembly is a pantograph assembly.

Advantageously in use, the bracket assembly presses at least a portion of the second abutment means further into abutment with the lower surface when the accessory bearing means is loaded with an accessory, and communicates the load to the first abutment means via a fulcrum at the edge of the desk pulling at least a portion of the first abutment means into further abutment with the upper surface.

In another preferred embodiment of the invention, an accessory bearing means is coupled to the first abutment means by a cantilevered coupling extending from the first abutment means and in use in a direction away from the desk edge.

Preferably the cantilevered coupling includes a post extending from the first abutment means which advantageously in use presses at least a portion of the first abutment means further into abutment with the upper surface when the bearing means is loaded with an accessory, and communicates the load to the second abutment means via a fulcrum at the edge of the desk pulling at least a portion of the second abutment means into further abutment with the lower surface.

Optionally the desk accessory support further includes at least a second accessory bearing means mounted to the post.

Preferably the cantilevered coupling includes a linkage assembly extending from a bracket assembly mounted to the first abutment means.

Preferably the cantilevered coupling allows adjustment of at least one of the position or orientation of the accessory bearing means.

Preferably the linkage assembly is a pantograph assembly.

Advantageously in use, the bracket assembly presses at least a portion of the first abutment means further into abutment with the upper surface when the accessory bearing means is loaded with an accessory, and communicates the load to the second abutment means via a fulcrum at the edge of the desk pulling at least a portion of the second abutment means into further abutment with the lower surface.

In another preferred embodiment of the invention, an accessory bearing means is coupled to the first abutment means by a cantilevered coupling extending from a pedestal adapted to abut the upper surface of the desk, and in use in a direction towards the desk edge, wherein the pedestal is also adapted to abut at least a portion of a lower surface of the first abutting means and in use is at least partially sandwiched in between the first abutting means and the upper surface of the desk.

Preferably the cantilevered coupling includes a post extending from the pedestal which in use advantageously presses at least a portion of the pedestal further into further abutment with the upper surface when the bearing means is loaded with an accessory.

In another preferred embodiment of the invention, the first abutment means includes a substantially upper planar surface which defines the at least one accessory bearing means.

Preferably the first abutment means includes a raised formation adjacent the connection means and in use the raised formation provides a wrist rest for a user operating a computer keyboard or mouse placed on the upper planar surface for support.

BRIEF DESCRIPTION OF THE DRAWINGS

Preferred embodiments of the invention will now be described, by way of example only, with reference to the accompanying drawings in which.

MODES FOR CARRYING OUT THE INVENTION

Figure 1:
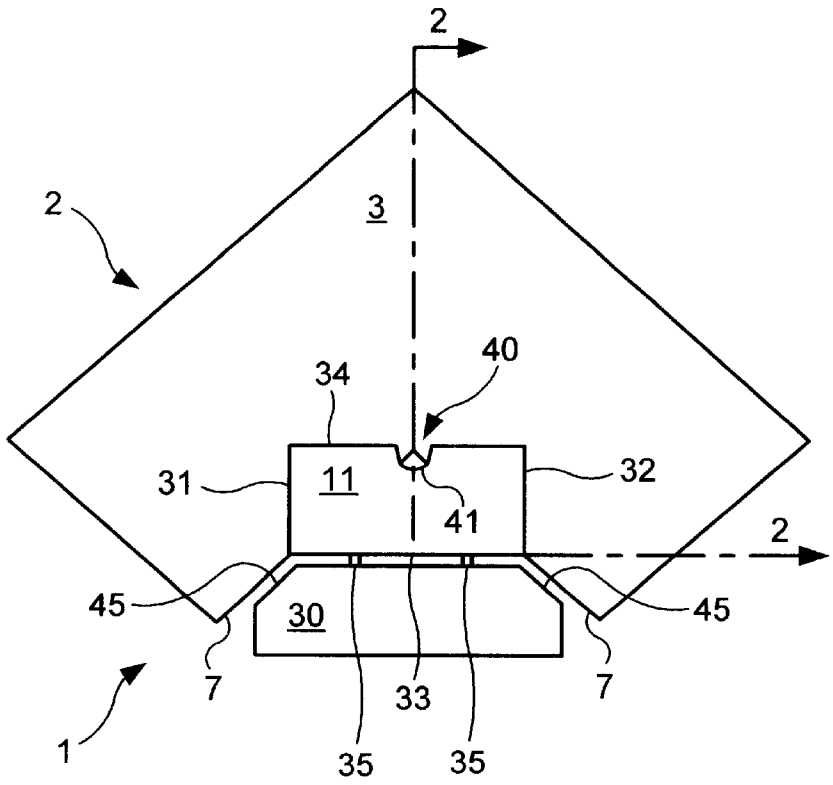
FIG. 1 is a top view of one embodiment of a desk accessory support according to the invention mounted to a desk.
Figure 2:
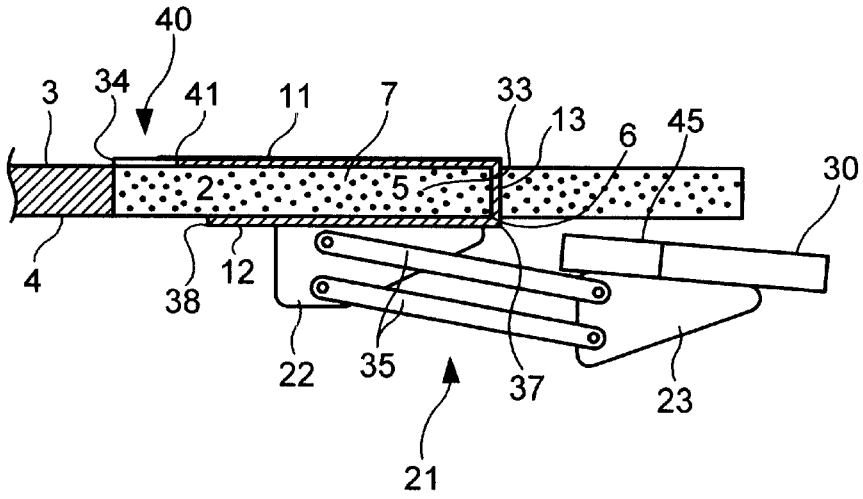
FIG. 2 is a sectional view along line 2—2 of FIG. 1.

Referring to FIG. 1 and FIG. 2, there is shown a keyboard support 1 for a desk 2 having a substantially planar upper surface 3 and an opposed co-extending lower surface 4 having respective straight edges 5 and 6. The edges are joined by a vertical sidewall 7 which extends in a plane and that is substantially normal to the upper and lower surfaces. Support 1 includes a first mounting means in the form of a planar rectangular metal plate 11 which abuts the adjacent upper surface 3. A second mounting means in the form of a second planar metal rectangular plate 12 is connected to plate 11 by way of an intermediate portion 13 and abuts the adjacent lower surface 4. Plates 11 and 12 are substantially parallel and, in combination, maintain support 1 in a predetermined disposition with respect to desk 2. A linkage assembly in the form of a pantographic linkage mechanism 21 extends from a first pair of parallel brackets 22 adjacent plate 12 to a second pair of like brackets 23. A keyboard support platform in the form of a support surface 30 is mounted to brackets 23 to selectively support a keyboard (not shown).

With reference to FIGS. 1 and 2, plates 11 and 12 and connecting portion 13 are preferably integrally formed from a single folded steel plate such that the distance between the opposed plate faces 11, 12 is substantially equal to the distance between desk edges 5 and 6. In other embodiments, opposed faces 11, 12 are disposed slightly further apart and use is made of respective strips of dense resilient foam to facilitate an interference fit between support 1 and desk 2, while also reducing the risk of any point loading.

In other embodiments plates 11 and 12 and connecting portion 13 are integrally constructed from plastics.

Linkage mechanism 21 includes four parallel arms 35 which are arranged in two spaced apart pairs which extend between respective brackets 22 and 23 to allow altitude adjustment of platform 30 with respect to desk 2. As would be appreciated by those skilled in the art other linkage mechanisms are also suitable. For example, in some embodiments the linkage mechanism allows tilt and/or altitude adjustment of platform 30, while in other embodiments platform 30 is fixed with respect to desk 2.

Linkage arms are connected to brackets 32 at a distance inwardly of connection 13 at the desk edge. Consequently the weight of platform 30 results in a torque being generated which is transmitted by arm 35 to plates 11 and 12. This torque forces the plates into more secure engagement with the respective adjacent surfaces 3 and 4. If an object such as a keyboard is placed on platform 30 it will increase the torque and hence the plates will more securely impinge upon the adjacent desk surfaces. Accordingly, an inherently safe self locking system is provided. For example, if an operator or other person inadvertently applies a load to platform 30, by leaning on it or otherwise, support 1 is further locked to desk 2.

As best shown in FIG. 1, upper and lower surfaces 3 and 4 are L-shaped and define a corner work station for a computer operator.

In the FIGS. 1 and 2 embodiment, plate 11 includes longitudinally extending edges 31 and 32 which are joined by transverse by extending edges 33 and 34. Plate 12 also includes longitudinally extending edges 31 and 32 and transversely extending edges 37 and 38. As shown, edge 38 is disposed intermediate edges 33 and 34 although in other embodiments edge 38 is adjacent to edge 34.

Plate 11 includes a slot 40 which extends longitudinally inwardly from edge 34 and terminates at rounded end 41. Slot 40 allows a cord extending between the keyboard and the associated computer to be discretely passed under plate 12 and then onto surface 3. This results in a more aesthetically pleasing arrangement which is also less likely to hinder the height adjustment of platform 30. In some embodiments slot 40 is large whereby plate 11 is in the form of a frame extending inwardly from the periphery of the plate shown in FIG. 1.

Support 1 is shown in FIG. 1 mounted to the corner of the L-shaped surfaces of desk 2. This is effected by initially manoeuvring edges 34 and 38 to be adjacent edges 7 and 8 respectively. Thereafter, plates 11 and 12 are biased away from each other to separate ends 34 and 38 sufficiently to allow their progression beyond edges 5 and 6. The biased is then removed allowing plates 11 and 12 to co-operatively grip surfaces 3 and 4, and, if required, support 1 further manoeuvred into a desired configuration. Although platform 30 is shown bridging the corner of desk 2, it is equally suitable for mounting along one of the straight edges, that is, with edge 34 maintained substantially parallel to any edge of the desk.

In FIG. 1, platform 30 extends transversely beyond plates 11 and 12 and includes bevelled sides 45 which lie flush with the adjacent sidewall 7. For embodiments of support 1 which are intended for symmetrical mounting in the corner of desk 2, bevelled sides 45 extend at 45° to edge 34. In other embodiments platform 30 transversely coextends with plate 11 and includes straight sides.

Figure 3:
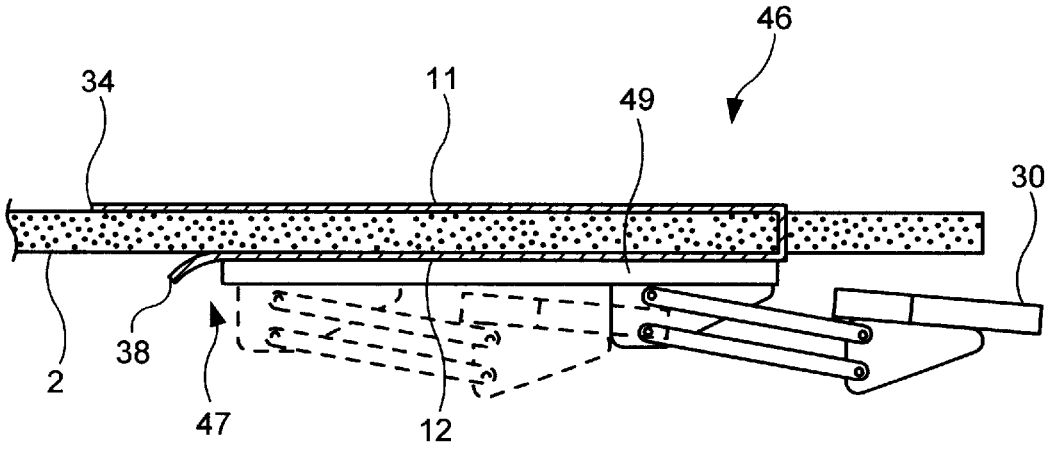
FIG. 3 is a view similar to FIG. 2 of a desk accessory support similar to that shown in FIG. 1 but adapted for forward/rearward adjustment of a keyboard platform.

Reference is now made to FIG. 3, where corresponding features are denoted by corresponding reference numerals. More particularly, a support 46 is illustrated which includes a plate 12 (second abutment means) having a down turned edge 38 defining a lip 47 for facilitating initial placement of the support on desk 2. Moreover, support 46 includes two parallel spaced apart longitudinally extending tracks 49 disposed between plate 12 and respective brackets 22. The brackets are captively and slidably mounted to the tracks to allow longitudinal progression of platform 30 between an extended and retracted configuration with respect to desk 2. Platform 30 is illustrated in the extended and retracted configurations by unbroken and broken lines respectively. Progression of platform 30 toward the extended and retracted configurations is limited, for example, by bump stops (not shown) adjacent portion 13 and lip 47 respectively. In some embodiments at least one of tracks 49 include a plurality of spaced apart locking formations which are selectively engaged by a complementary formation on the adjacent bracket 22 to effect positive locating of that bracket with respect to the track.

Figure 4:
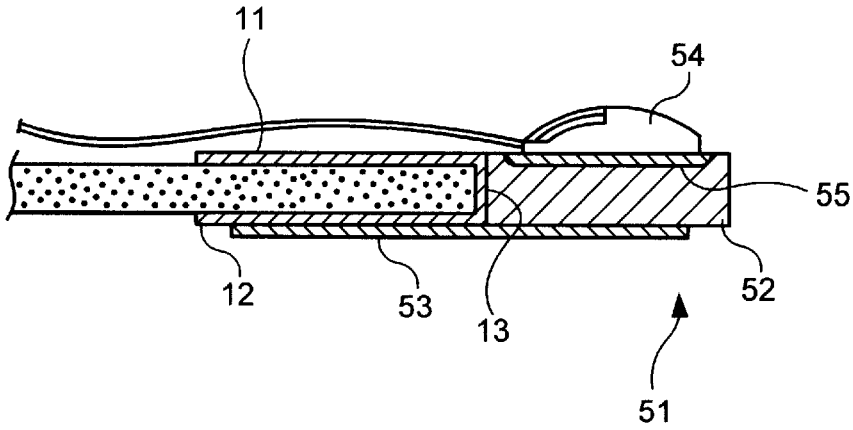
FIG. 4 is a part side sectional view of another embodiment of a desk accessory support according to the invention provided with an auxiliary mouse platform.

Platform 30, in some embodiments, has a sufficiently large surface area to accommodate, in addition to the keyboard, one or more other input devices such as a mouse, joystick, removable hard drive, tape drive or the like. However, in some circumstances an operator requires additional space to conveniently locate input devices for the computer other than directly on platform 30. This is easily achieved through use of the embodiment of the invention illustrated in FIG. 4 and generally designated as auxiliary platform 52.

Auxiliary platform 52 includes plates 11 and 12 and portion 13, similarly to the other embodiments described above. However, in this case, auxiliary platform 52, is substantially smaller than platform 30 and fixed with respect to plates 11 and 12 by a pair of parallel underlying beams 53. These beams are fixedly attached to plate 12 and convert any torque arising from a load applied to platform 52 into a locking force between plates 11 and 12 and respective adjacent surfaces of desk 2.

In some embodiments platform 52 is mounted to platform 30 rather than desk 2.

Platform 52 is intended to support a mouse 54 or other input device. In this embodiment the upper surface of the platform includes a neoprene layer 55 to facilitate operation of mouse 54.

Platforms 30 and 52 can all be retrofitted to existing desks or other surfaces without any modifications being required. Moreover, platforms 30 and 52 are easily moved for optimum placement by applying a bias to the support surface to counteract the gravitational bias applied by any load carried by that surface.

Platforms 30 and 52 being cantilevered from plate 12 are self-locking and ensures that when a load is applied to the platform surface that the support will be more securely located on the desk.

As support 1 extends beyond sidewall 7 of desk 2 it provides a user with additional desk space and allows that user to comfortably and easily maintain a greater distance between their eyes and the screen.

Figure 5:
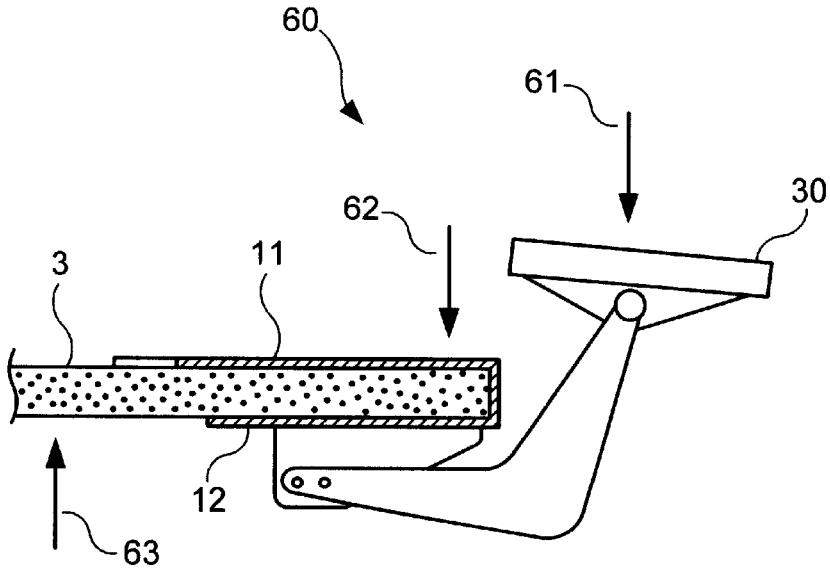
FIG. 5 is a part side sectional view of another embodiment of a desk accessory support according to the invention showing a keyboard platform in a raised configuration.
Figure 6:
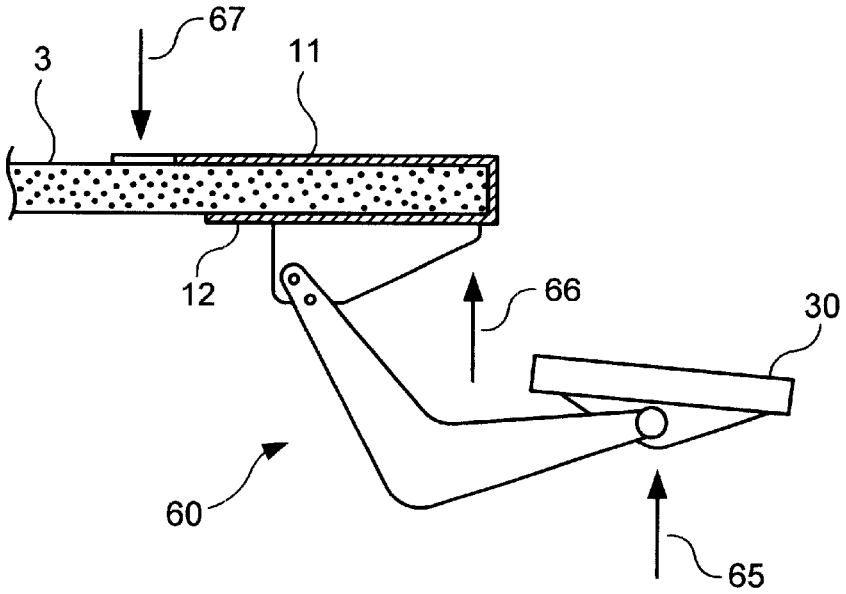
FIG. 6 is the view of the embodiment of the desk accessory support in FIG. 5 with the keyboard platform shown in a lowered configuration.

Reference is now made to FIGS. 5 and 6 which illustrate an alternative support 60, where corresponding features are denoted by corresponding reference numerals. These figures are intended to show the direction the forces acting upon plates 11 and 12 during upward and downward adjustment of platform 30. More particularly, in FIG. 5 platform 30 is in the raised configuration and a downward force represented by arrow 61 is applied to move the platform to a reduced height with respect to desk 3. This results in the generation of forces represented by arrows 62 and 63 respectively on the front and rear edges of plates 11 and 12. These forces act to further lock support 60 to desk 3. When platform 30 is in the lowered configuration, as shown in FIG. 6, it is necessary to apply an upward force, represented by arrow 65 to more the platform surface to a higher position with respect to desk 3. With the application of force 65, two forces are generated, represented by arrows 66 and 67, respectively, which act on the front and rear of plates 12 and 11. Again, locking action is effected.

The application of either of forces 61 or 65 has the desired effect of locking support 60 to desk 3, notwithstanding the opposed nature of these forces.

Figure 7:
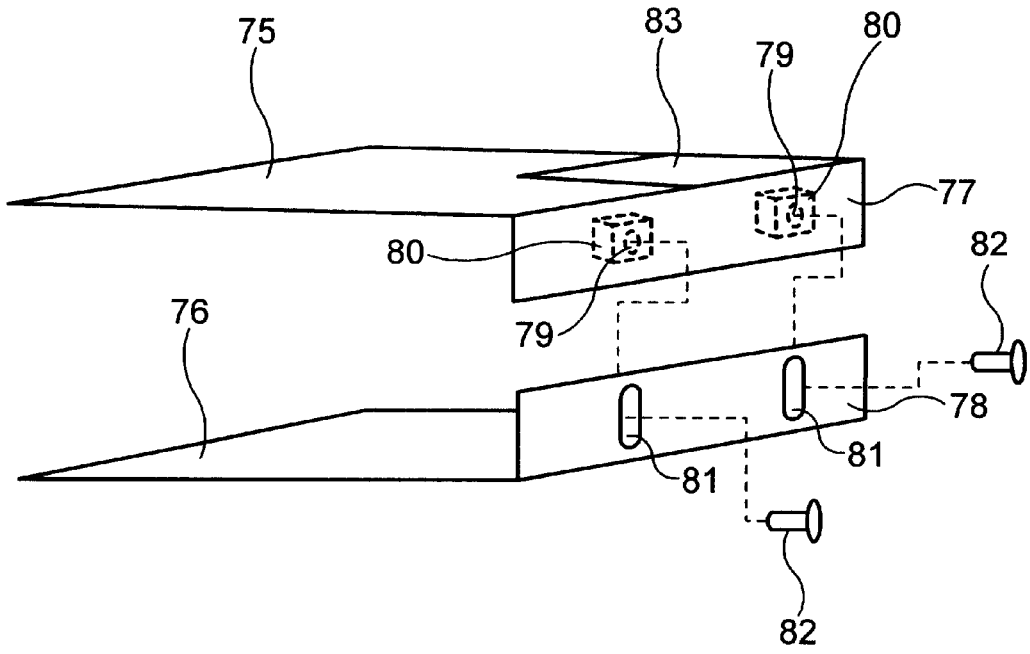
FIG. 7 is a perspective view of another embodiment of a desk accessory support according to the invention having adjustably spaced mounting plates.

Reference is now made to FIG. 7 which is a perspective view of two plates 75 and 76 which form part of a keyboard support according to the invention. For the purposes of clarity the linkage assembly has been omitted, although it will be appreciated that, in use, such an assembly extends from the bottom of plate 76.

Plates 75 and 76 are opposed and include respective flanges 77 and 78 which extend toward the other of the plates. Preferably, each flange extends normally from its respective plate.

Flange 77 includes two spaced apart circular apertures 79 and corresponding nuts 80. In other embodiments nuts 80 are omitted and apertures 79 are threaded.

Flange 78 includes two spaced apart parallel extending slots 81 which, in use overlie apertures 79. Respective bolts 82 are inserted through slots 81 and apertures 79, and threaded into engagement with nuts 80 to maintain flanges 77 and 78 in a fixed spaced apart configuration.

During installation of the keyboard support to a desk, bolts 82 are loosened to allow movement of plates 75 and 76 into engagement with respective opposed surfaces of a desk. Thereafter, bolts 82 are tightened with respect to nuts 80 to securely maintain the plates in the engaged configuration. Accordingly, plates 75 and 76 accommodate a variety of desk thicknesses.

Plate 75 includes a mouse pad 83 in the top right hand corner. This allows a user convenient access to the keyboard, which is located on the support platform (not shown) and a mouse located on pad 83.

An alternative arrangement is illustrated in FIG. 8 where, again, the linkage assembly has been omitted for clarity purposes. More particularly, two spaced apart, substantially parallel plates 85 and 86 are integrally formed and are joined by an intermediate curved resilient portion 87. Portion 87 flexes to allow a greater separation between plates 85 and 86, thereby accommodating a range of desk thicknesses, while resiliently biasing plates 85 and 86 to co-operatively grip the desktop (not shown).

Figure 9:
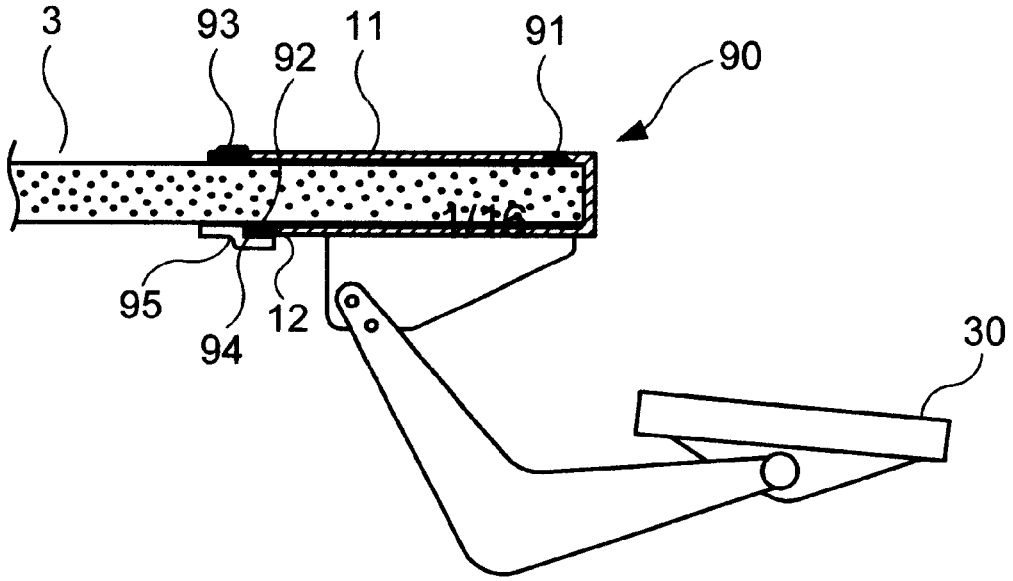
FIG. 9 is a side view of another embodiment of a desk accessory support according to the invention.

An alternative embodiment keyboard support 90 is illustrated in FIG. 9. Support 90 is similar to support 60, as illustrated in FIG. 6, and corresponding features are denoted by corresponding reference numerals. The plates 11 and 12 of the FIG. 9 embodiment are spaced slightly further apart than those shown on FIG. 6 to provide a small gap between the plates and the respective adjacent surfaces of desk 3.

Plate 11 and plate 12 both include spaced apart rubber feet 91 and 92 which are respectively disposed at the front and rear of those plates. When a downward load is applied to platform 30 feet 91 and 92 are biased into gripping engagement with the adjacent desk surfaces.

Plate 11 also includes a rearwardly disposed spherical roller 93 which is engaged with the top surface of desk 3 when an upwardly directed force is exerted upon platform 30. Such an upwardly directed force will also remove feet 91 and 92 from gripping engagement with the desk surfaces. Accordingly, movement of support 90 is facilitated.

The FIG. 9 embodiment of the invention is intended for mounting to the straight edge of a desk and for subsequent transverse movement along that edge. Preferably, therefore, desk 3 includes a guide in the form of a transversely extending track 94 which overlaps with the rear of plate 12 to facilitate a smooth progression. Track 94 is maintained against desk 3 by way of a plurality of spaced apart screws 95.

Support 90 is easily transversely progressed by a user who simply needs apply an upwardly directed force to platform 30 to overcome the gripping engagement of feet 91 and 92. Support 90 is then progressed transversely, as required, and the upwardly directed force is removed. Platform 90 is then biased downwardly under the influence of gravity and from any resilience between plates 11 and 12 whereby feet 91 and 92 are again biased into gripping engagement with desk 3.

In another embodiment plate 12 includes formations for selectively engaging with a plurality of corresponding transversely spaced apart formations on the lower surface of desk 3. The interengagement between the formations effecting an even more positive engagement between the desk and support. When an upwardly directed force is applied to the platform the rear edge of plate 12 is progressed downwardly such that the formations are disengaged and either transverse and/or longitudinal movement of the support relative to the desk can occur.

Figure 10:
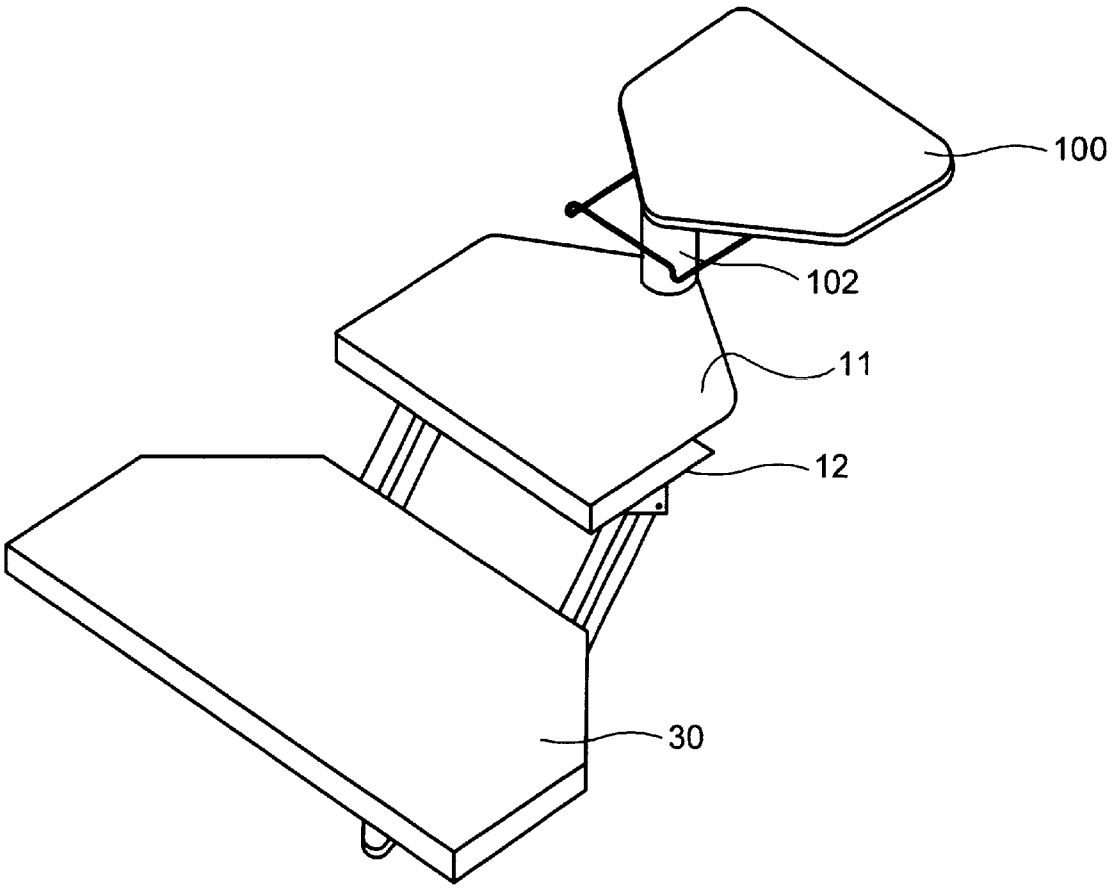
FIG. 10 is a perspective view of a another embodiment of a desk accessory support according to the invention having a monitor platform and a keyboard platform.

With reference to FIG. 10 there is shown an embodiment similar to that of FIG. 1 but wherein a second load bearing platform 100 (in this case adapted to support a monitor) is mounted to first abutment means 11 (the upper plate) by means of a mounting post 102 spaced inwardly from edge connection 13. Desirably mounting post 102 is provided with telescopic, airlift, or other height adjustment and may also be provided with swivel adjustment.

Figure 11:
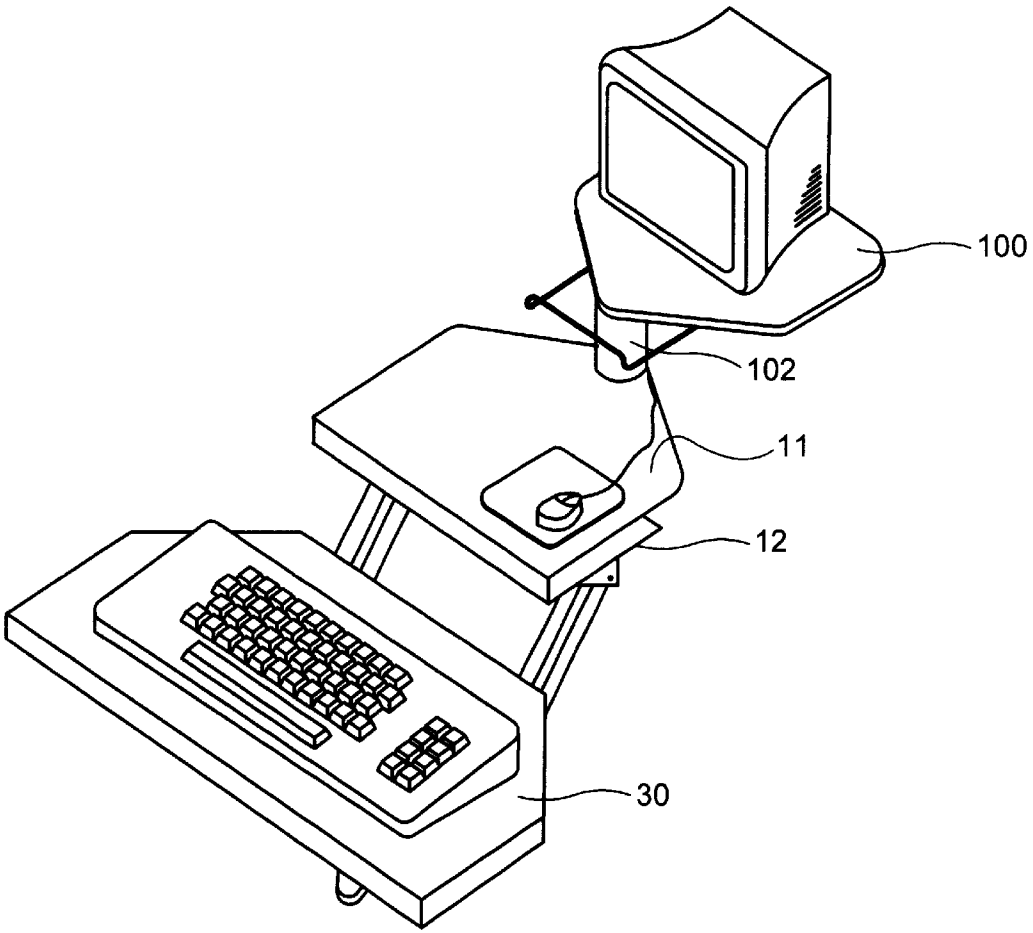
FIG. 11 is a perspective view of the embodiment in FIG. 10 bearing a mouse pad keyboard and monitor.

FIG. 11 shows the embodiment of FIG. 10 when supporting a monitor on platform 100, a keyboard on platform 30 and a mouse on upper plate 11.

Figure 12:
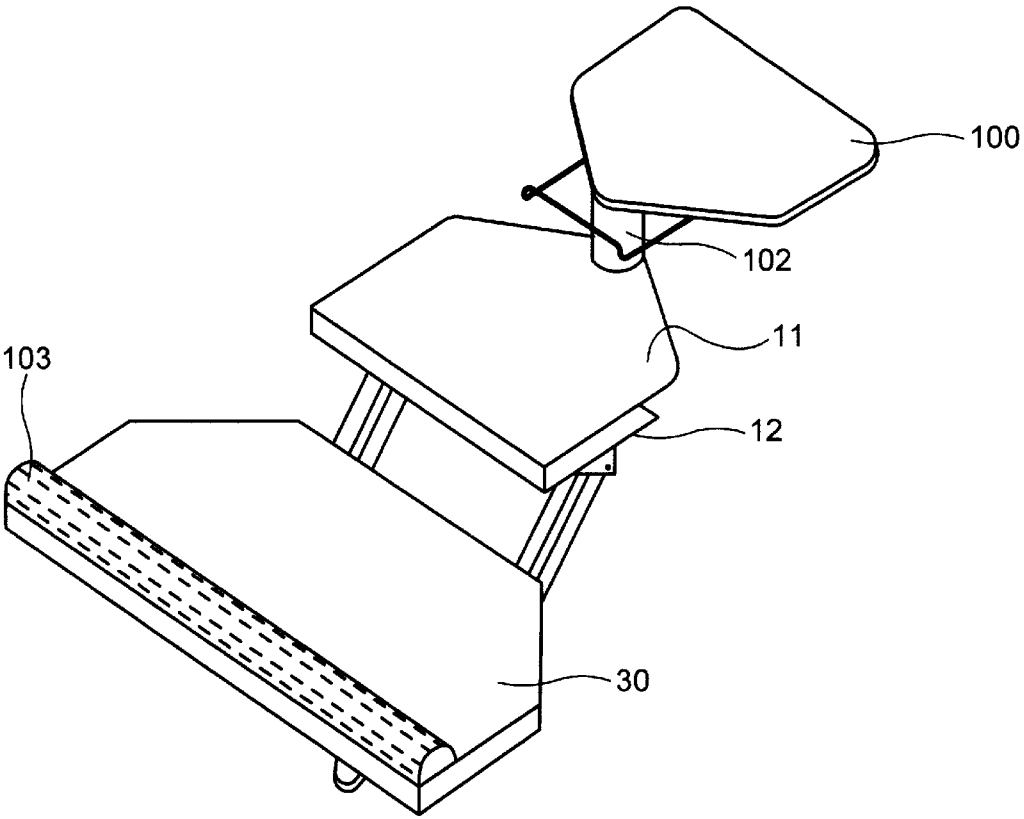
FIG. 12 is a perspective view of a variation of the embodiment shown in FIGS. 10 and 11 having a wrist rest attached to the keyboard platform.

FIG. 12 shows an embodiment similar to that of FIG. 10 but wherein keyboard support platform 30 is provided with a wrist support 103.

Figure 13:
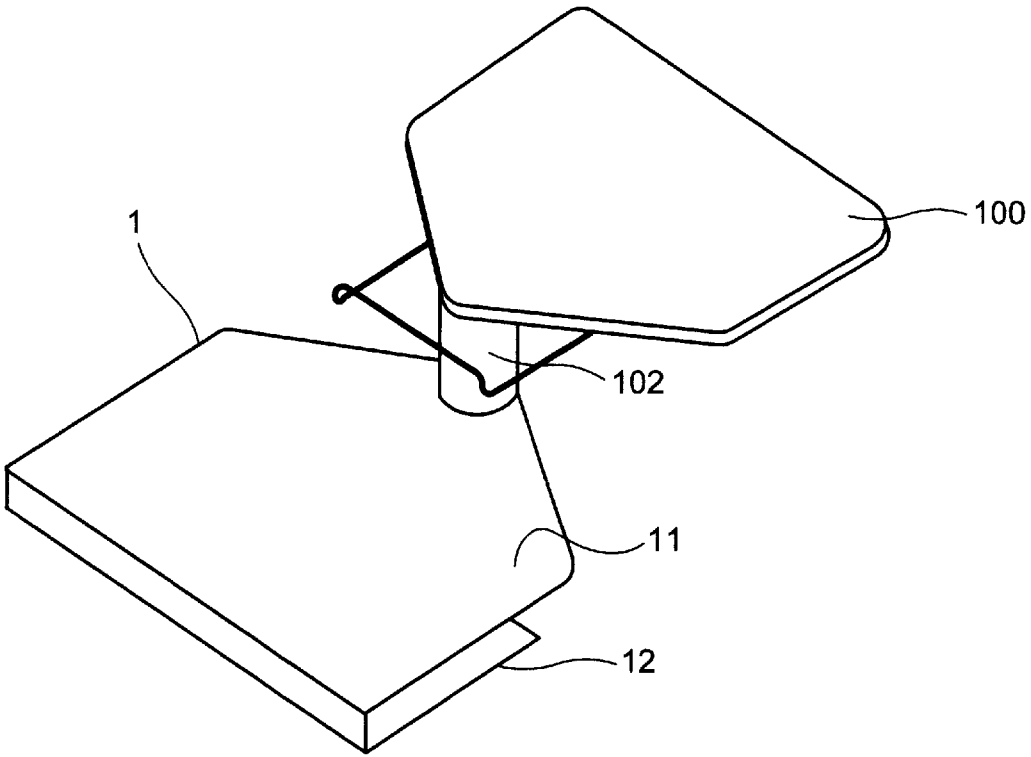
FIG. 13 is a perspective view of a variation of the embodiment shown in FIGS. 10 and 11 omitting the keyboard platform.

FIG. 13 shows an embodiment wherein a monitor platform 100 is supported by a support pillar 102 from upper plate 11 of support means 1. As shown in FIG. 13 in this embodiment no separate support platform is provided for a keyboard. Instead, as is shown in FIG. 14, upper plate 11 may be provided with a wrist support 103 and the keyboard may be emplaced upon upper plate 11.

Figure 14:
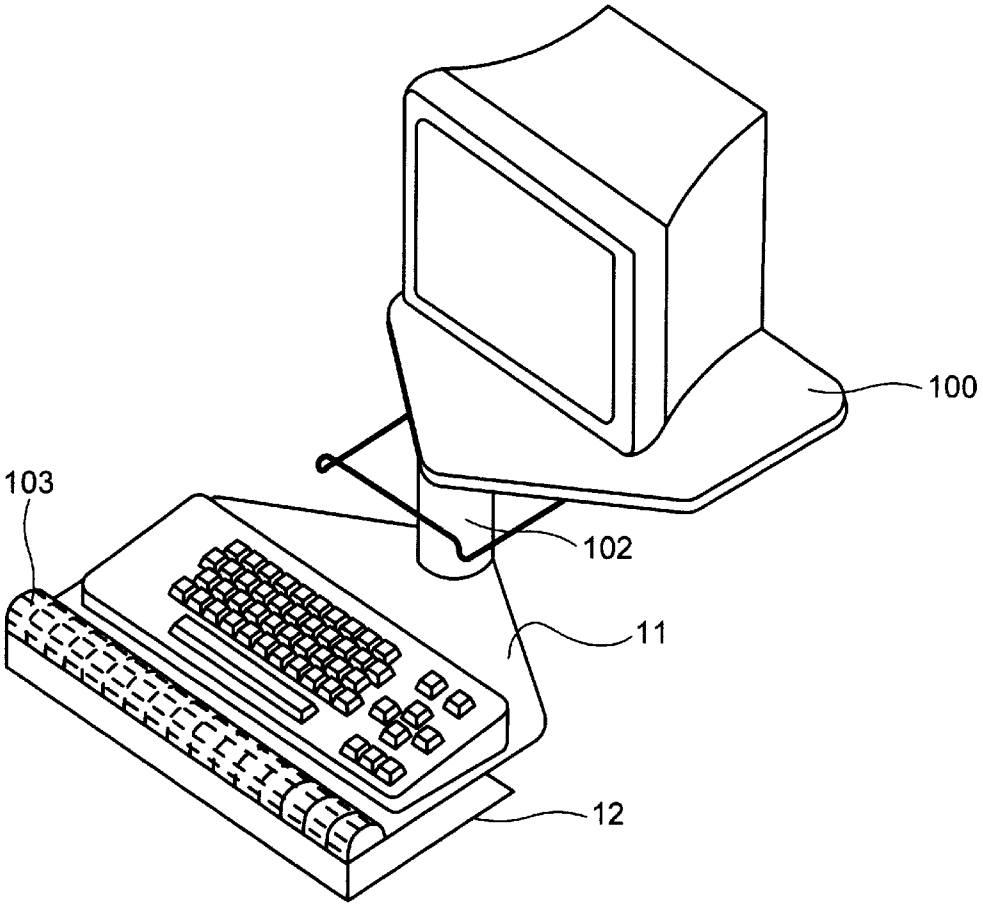
FIG. 14 is a perspective view of the embodiment shown in FIG. 13, bearing a monitor, a writs rest and a keyboard.
Figure 15:
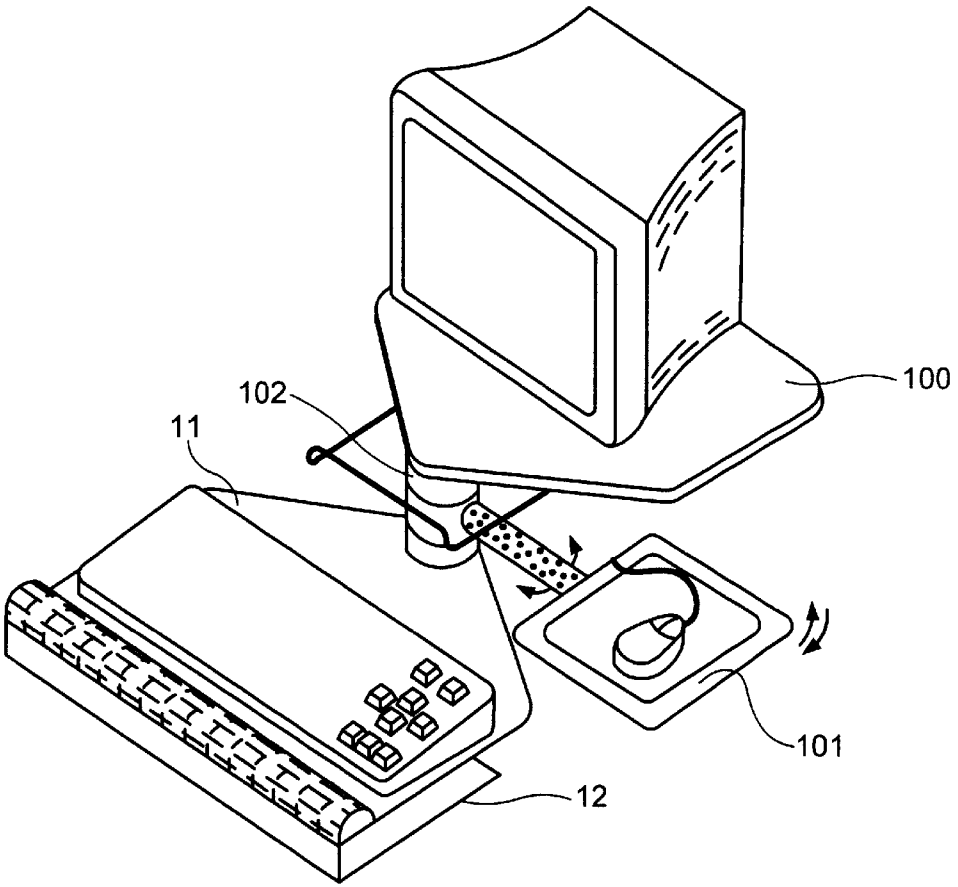
FIG. 15 is a perspective view of the embodiment shown in FIGS. 13 and 14 further provided with a swing-away mouse platform.

FIG. 15 shows a further embodiment similar to that of FIG. 14 but wherein mounting pillar 102 is provided with a laterally extending auxiliary platform 101 whereby a mouse may be supported. It will be appreciated that the embodiments of FIGS. 13, 14 and 15 share the same stability as embodiments earlier described in that the loads in each case tend to improve the grip between the support means and the desk.

Figure 16:
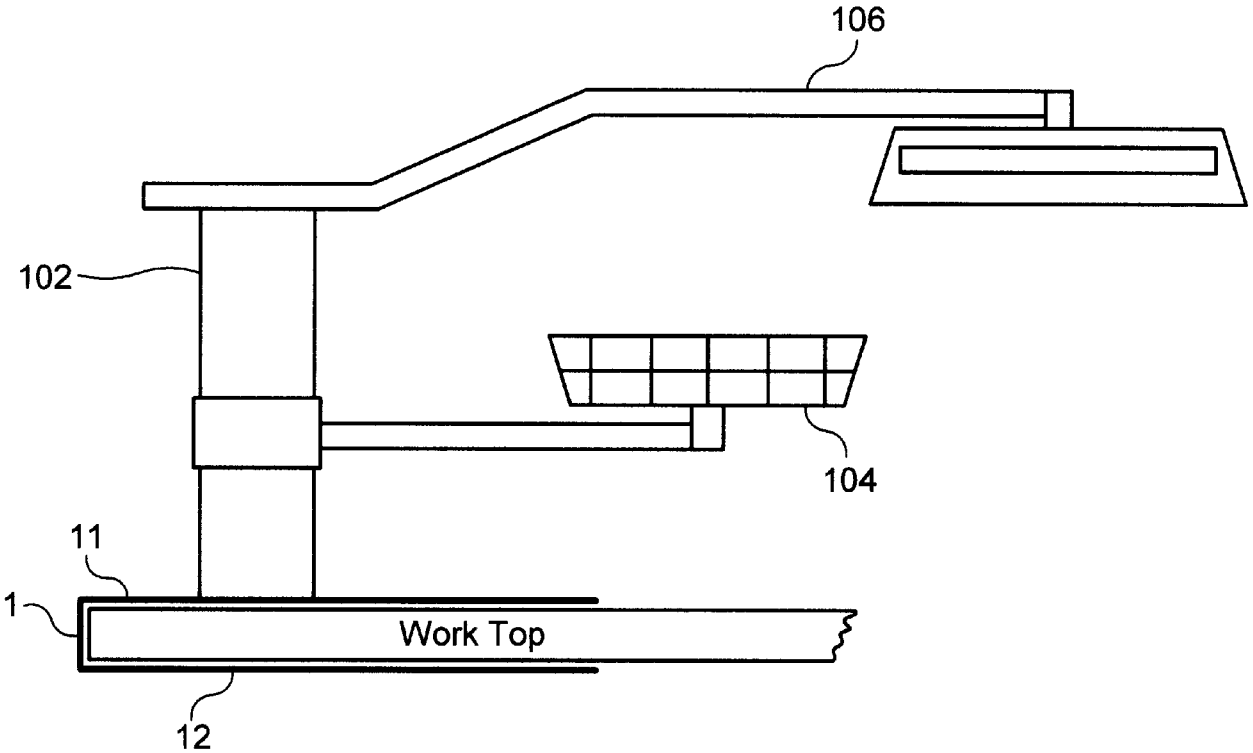
FIG. 16 shows a side view of another embodiment of a desk accessory support according to the invention with an accessories column.

FIG. 16 shows an embodiment in which a basket 104 and a task light 106 are supported via a pillar 102 from upper plate 11. It will be understood that in each case pillar 102 may be made of adjustable length and horizontal support arms may be adjustable in height and radial direction from the pillar.

Figure 17:
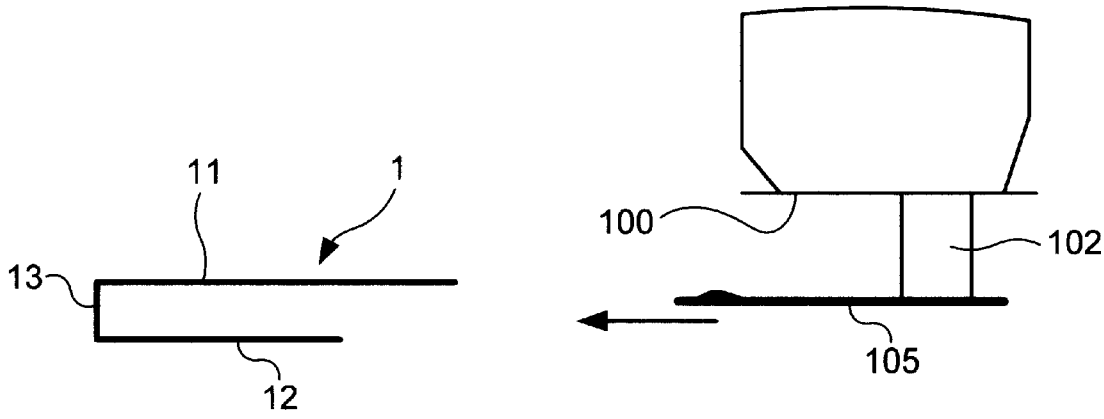
FIG. 17 shows another embodiment of a desk accessory support according to the invention provided as a two-part assembly.
Figure 18:
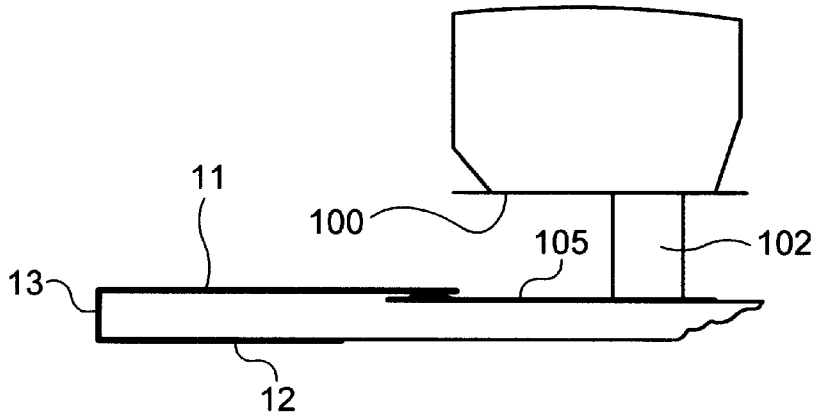
FIG. 18 shows the two-part assembly of FIG. 17 when in use.

FIG. 17 shows an embodiment wherein a monitor support platform 100 is supported by a column 102 from a base plate 105 and wherein as shown in FIG. 18 base plate 105 is clamped onto a desk top by means of support 1 engaging base plate 105 between upper plate 11 and the desk top.

Figure 8:
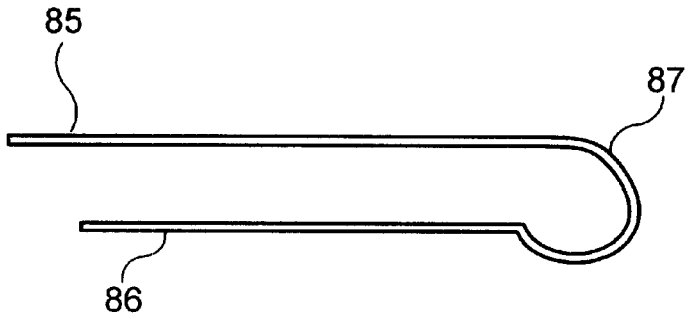
FIG. 8 is a side view of another embodiment of a desk accessory support according to the invention having resiliently biased plates.
Figure 19:
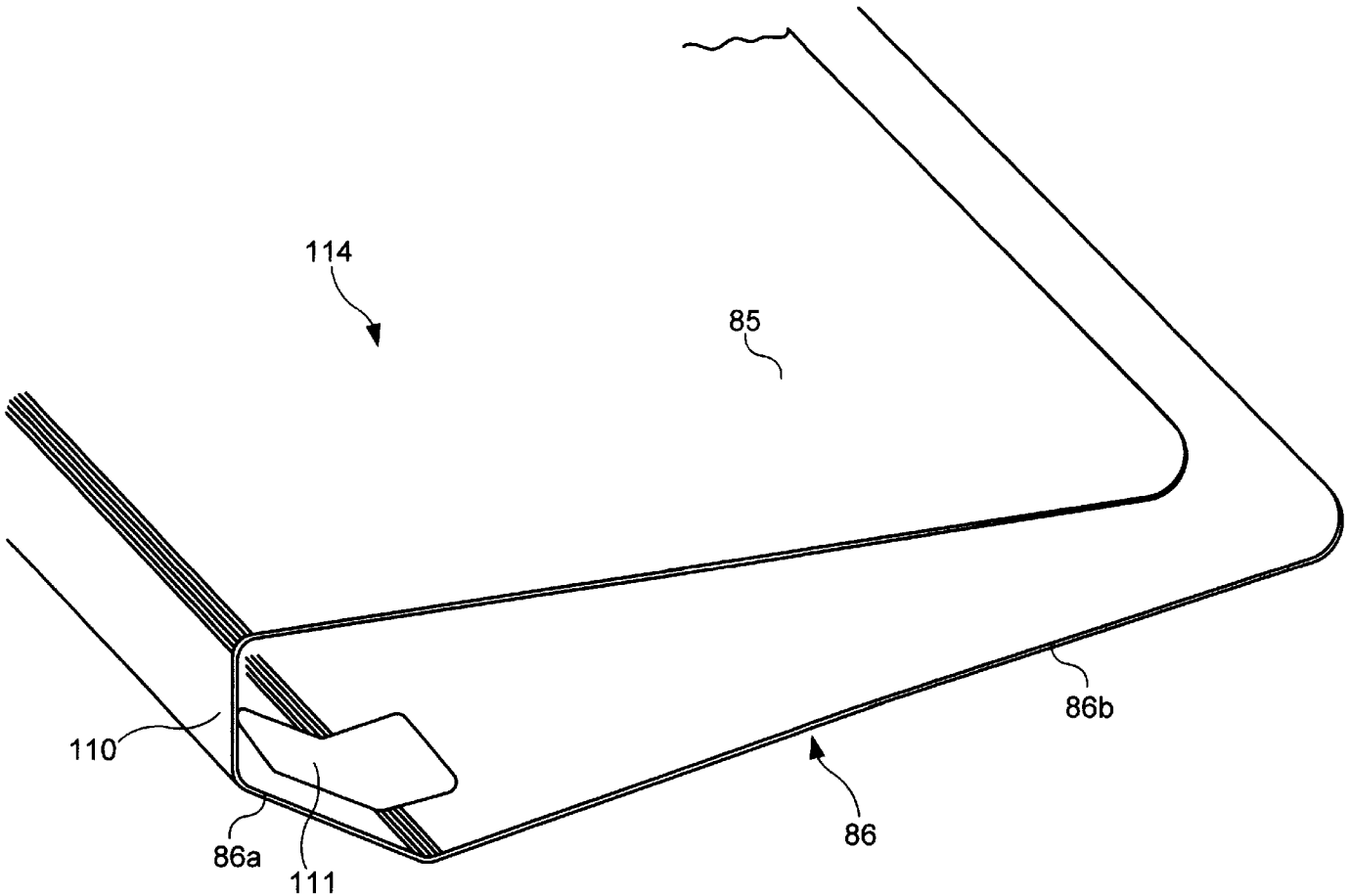
FIG. 19 is a part perspective view of another embodiment of a desk accessory support according to the invention having a bent bottom plate.

FIG. 19 illustrates an alternative embodiment to those shown in FIGS. 7 and 8. The embodiment in FIG. 19 includes an upper plate 85 integrally connected to a lower bent plate 86 via an intermediate portion 110. The bent plate 86 includes a portion 86*a* disposed in a direction away from the upper plate 85, and a portion 86*b* disposed in a direction towards upper plate 85. Plates 85 and 86 are resiliently biased in a direction towards each other, and advantageously this embodiment will allow the desk accessory support 114 to be used in respect of the desk tops (not shown) of different thicknesses. Preferably rubber pads 111 are provided on the upper surface of the lower plate 86 in the vicinity of where portion 86*a* meets 86*b* which provides protection to the lower edge of a desk top (not shown) when the accessory support is applied to a desktop where the desk thickness is greater than the height of the intermediate portion 110.

Figure 20:
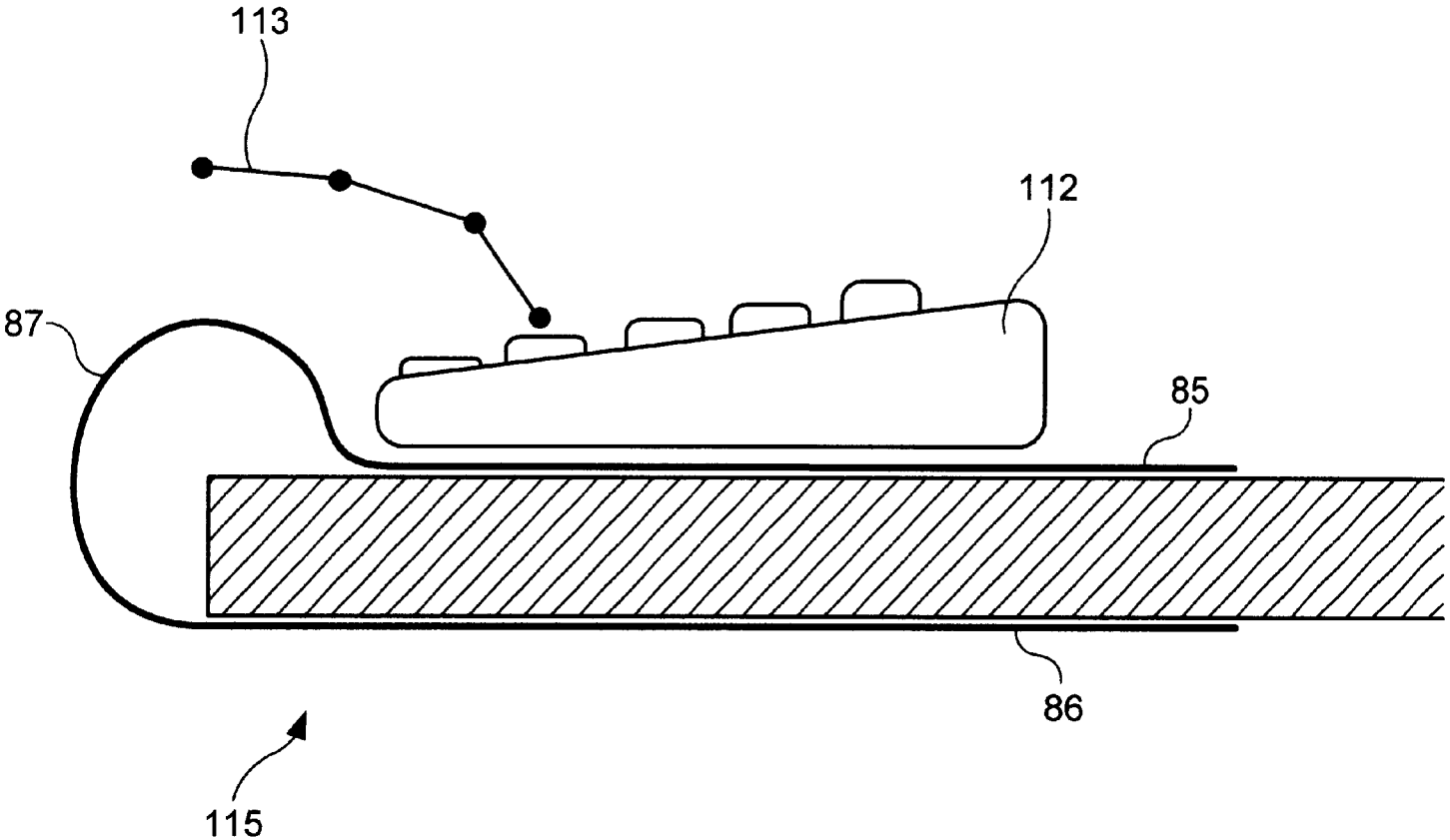
FIG. 20 is a part cross sectional side view of another embodiment of a desk accessory support according to the invention with an integral wrist rest and bearing a keyboard.

The embodiment of the desk accessory support 115 in FIG. 20 is an alternative embodiment to the embodiment illustrated in FIG. 8. The numeric references in FIG. 20 which are also in FIG. 8 refer to the same features in both illustrations. However, the support 115 in FIG. 20 includes an intermediate curved resilient portion 87 formed in a manner to provide a raised formation with respect to upper plate 85 which in use provides a wrist rest for a user operating for example a computer keyboard 112 which has been placed on the upper plate 85.

Advantageously the wrist rest feature 87 is integrated with the upper plate 85 and lower plate 86 of the support 115. Finger 113 is a schematic representation of human fingers which illustrates the intermediate portion/wrist rest support 87 for the purposes of providing physical support to a human hand.

Figure 21:
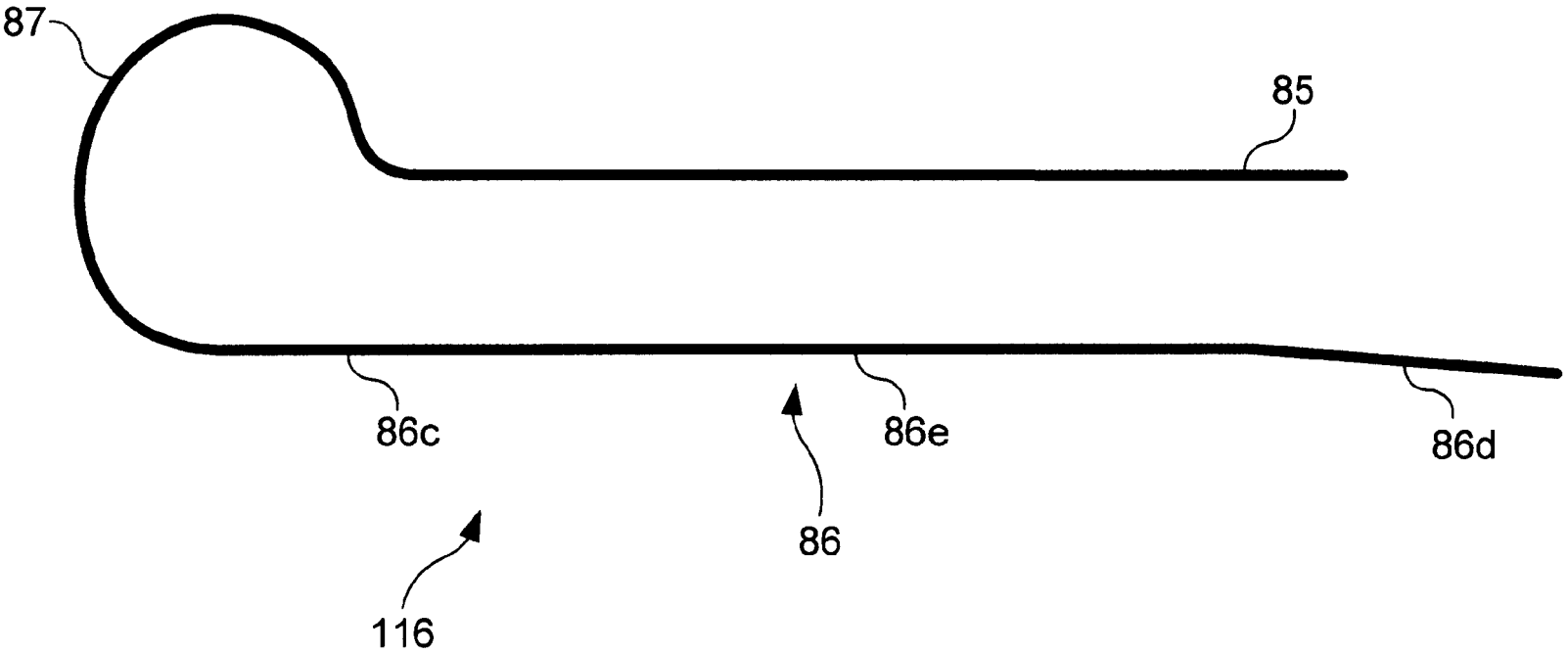
FIG. 21 is a side view of a variant of the embodiment shown in FIG. 20 having a bent bottom plate and a lead in lip on the bottom plate.

The embodiment of the accessory support 116 shown in FIG. 21 is an alternative embodiment to that illustrated in FIG. 20. The support 116 includes a lower plate 86 bent into 3 portions 86*c*, 86*d* and 86*e*. Lower plate 86 is provided with a lip portion 86*d* to assist the location of the accessory support 116 on a desk top. The bent portion 86*c* allows the desk accessory support 116 to be applied to thinner desk tops while maintaining the same size wrist rest support 87 for example when compared to the embodiment illustrated in FIG. 20.

As will be apparent to those skilled in the art from the teaching hereof features of one embodiment may be combined with those of another and the apparatus may be constructed from any suitable materials and in forms differing from those depicted in the drawings without departing from the scope of the invention herein disclosed.

What is claimed is:

1. A desk accessory support for use with a desktop having an upper surface, a lower surface and an edge extending between the upper and lower surfaces, the support including:

first abutment means for abutting the upper surface;

second abutment means for abutting the lower surface, at least a portion of the second abutment means being resiliently displaceable away from at least a portion of the first abutment means such that said portions are biased towards each other for cooperatively gripping the desktop;

connection means configured for connecting the first and second abutment means to each other and for being disposed adjacent to the edge when the first and second abutment means are in abutment with the upper and lower surfaces respectively;

said first and second abutment means and said connection means defining a substantially U-shaped recess for receiving the edge of the desktop;

at least one accessory being means connected to the second abutment means by means of a cantilevered coupling extending from the second abutment means so as to be at a distance from the edge in use;

said cantilevered coupling adapted to allow adjustment of the position or orientation of the accessory bearing means with respect to the desk top;

wherein a load applied to the accessory bearing means by an accessory carried thereon causes a moment on one of the first and second abutments means which urges at least a part of one of the first and second abutment means towards a part of the other abutment means, for causing deformation of at least one of the first and second abutment means and the connection means thereby to cause at least one of said parts more firmly to impinge upon the corresponding surface of the desktop to increase the grip of the first and second abutment means on the desktop.

2. The desk accessory support of claim 1 wherein said connection means is effective for resiliently connecting the first and second abutment means to each other such that said abutment means are biased towards each other on being moved away from each other.

3. The desk accessory support of claim 1 wherein the first abutment means includes a substantially planar upper surface, and the connection means includes a planar portion extending between the first and second abutments means, where in use, the connection means is disposed to abut a non linear edge of the desktop at two locations, and at least a portion of the first abutment means spans the region defined by the connection means and the portion of the non linear edge of the desktop between the two locations.

4. The desk accessory support of claim 1 wherein the first and second abutment means include substantially parallel upper and lower planar fins respectively, which in use extend away from the edge and along at least a portion of the respective upper and lower surfaces.

5. The desk accessory support of claim 1 wherein the first and second abutment means are substantially rectangular.

6. The desk accessory support of claim 1 wherein the first and second abutment means are plates.

7. The desk accessory support of claim 6 wherein the first and second abutment means are integrally formed plates.

8. The desk accessory support of claim 1 wherein the first and second abutment means are releasably connected together.

9. The desk accessory support of claim 1 wherein the first and second abutment means are adjustably spaced apart at a predetermined distance.

10. The desk accessory support of claim 1 wherein the accessory bearing means is coupled to the second abutment means at a coupling position, by a cantilevered coupling extending, in use, at least partly in a direction from the coupling position to the edge, said moment causing said part of the second abutment means more firmly to impinge upon the lower surface.

11. The desk accessory support of claim 10 wherein the cantilevered coupling includes a linkage assembly extending from a bracket assembly mounted to the second abutment means at the coupling position.

12. The desk accessory support of claim 10 wherein the linkage assembly is a pantograph assembly.

* * * * *

UNITED STATES PATENT AND TRADEMARK OFFICE

CERTIFICATE OF CORRECTION

PATENT NO. : 6,527,235 B1
DATED : March 4, 2003
INVENTOR(S) : Michael John Cotterill It is certified that error appears in the above-identified patent and that said Letters Patent is hereby corrected as shown below:

Column 10,
Line 66, delete "one accessory being" and replace with -- one accessory bearing --

Signed and Sealed this

Twenty-ninth Day of July, 2003

JAMES E. ROGAN
*Director of the United States Patent and Trademark Office*